United States Patent [19]

Desjonqueres et al.

[11] Patent Number: 5,074,104

[45] Date of Patent: Dec. 24, 1991

[54] DEVICE FOR PROCESSING PRODUCTS IN A CONTROLLED ATMOSPHERE AND AT A CONTROLLED TEMPERATURE AND PARTICULARLY FOOD PRODUCTS

[76] Inventors: Olivier Desjonqueres; Zsuzsanna Desjonqueres, both of Colline du Crepon, F-84110, Faucon, France

[21] Appl. No.: 499,493

[22] PCT Filed: Oct. 28, 1988

[86] PCT No.: PCT/FR88/00529

§ 371 Date: Jun. 25, 1990

§ 102(e) Date: Jun. 25, 1990

[87] PCT Pub. No.: WO89/04277

PCT Pub. Date: May 18, 1989

[30] Foreign Application Priority Data

Oct. 30, 1987 [FR] France ..... 87/15251
Dec. 9, 1987 [FR] France ..... 87/17373

[51] Int. Cl.[5] ..... B65B 55/18

[52] U.S. Cl. ..... 53/510; 53/111 R; 53/167; 53/431; 53/551

[58] Field of Search ..... 53/431, 510, 511, 515, 53/111 R, 551, 167; 426/410, 418

[56] References Cited

U.S. PATENT DOCUMENTS

| | | | |
|---|---|---|---|
| 2,113,636 | 4/1938 | Vogt | 53/511 X |
| 3,336,722 | 8/1967 | Van Der Winden | 53/426 |
| 3,376,688 | 4/1968 | Takacs | 53/431 |
| 3,579,945 | 5/1971 | Buchner | 53/511 |
| 3,587,203 | 6/1971 | Miles | 53/515 X |
| 3,654,048 | 4/1972 | Bathgatz | 53/431 X |
| 4,409,775 | 10/1983 | Brody | 53/167 |
| 4,955,178 | 9/1990 | Shroyer | 53/167 X |

FOREIGN PATENT DOCUMENTS

| | | | |
|---|---|---|---|
| 331721 | 9/1958 | Fed. Rep. of Germany | 53/167 |

*Primary Examiner*—John Sipos
*Attorney, Agent, or Firm*—Fleit, Jacobson, Cohn, Price, Holman & Stern

[57] ABSTRACT

A hermetically sealed case (2) delimits a chamber (7) with an inert atmosphere within which are located a series of product processing and transfer stations (10,14,19,21,22). A product washing means (5,6) forms an inlet lock to the chamber while a product packaging means (23,24,26,30) forms an exit lock from the chambrer.

6 Claims, 2 Drawing Sheets

Figure 1:
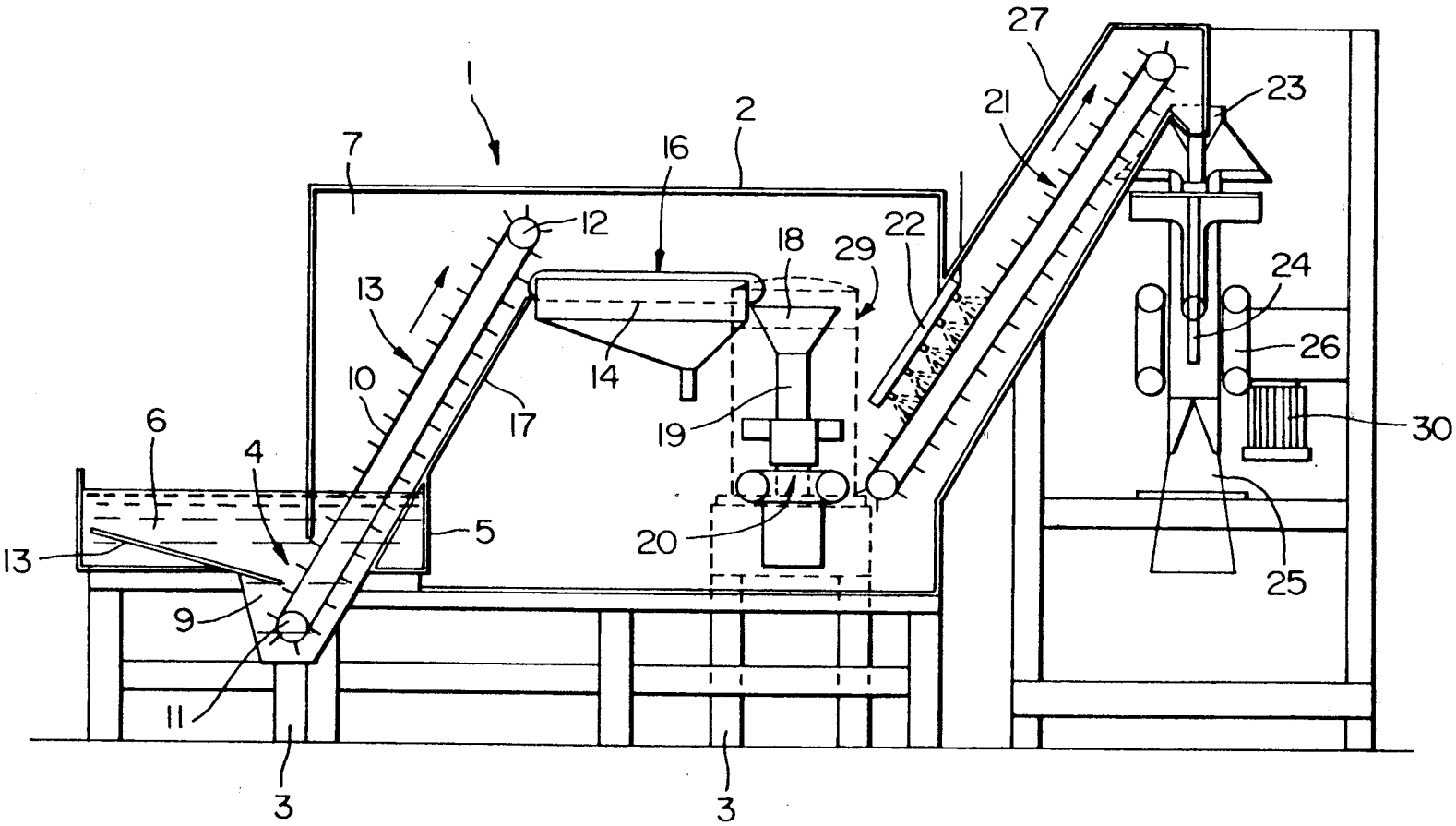

DEVICE FOR PROCESSING PRODUCTS IN A CONTROLLED ATMOSPHERE AND AT A CONTROLLED TEMPERATURE AND PARTICULARLY FOOD PRODUCTS

The invention, which has as object a device for processing products in a controlled atmosphere and at a controlled temperature and particularly food products, relates more precisely to providing an inert atmosphere in the zone in which said products are prepared as well as the particular means which are associated therewith for introducing the product into the zone and removing it.

In the manufacture of certain food products, such for example as fruit emulsions or else different vegetables, potatoes, celery, etc. . . which must be processed and prepared for deep-freezing or packing, it is absolutely necessary to protect the product in question from oxidation thereof in free air, which results in yellowing, more particularly for fruits such as apples or avocado pears or potatoes. For the latter, precisely, which are very widely used for manufacturing deep-frozen or frozen chips, it is usual to process them in several manufacturing steps with metabisulfite which is a powerful antioxidant and which protects them from yellowing in free air. When metabisulfite is used in massive doses, it whitens the potatoes which are impregnated therewith and which may then absorb the oxygen which may possibly migrate through the wall of its packing, which makes it possible to use a packing bag permeable to oxygen, so thinner and less costly. On the other hand, processing with metabisulfite has the drawback of making potatoes spongy when being cooked, but also of freeing enzymes adversely affecting the taste quality of the consumed product.

It was then preferred to turn to a freezing method with pre-cooking which has the main advantage of blocking the process of releasing enzymes mentioned above. But in this case the chips obtained become crumbly. And then, if the use of metabisulfite is limited by the general directions laid down by the testing services, it is then necessary to take considerable precautions in packing the processed products so as to prevent oxygen from acting on the product.

One of the merits of the invention resides precisely in the fact that it makes it possible to limit very considerably the amount of metabisulfite used before processing and packing of the food product because it provides an inert atmosphere in the whole preparation zone of the product, towards which zone, in which and from which the product is processed continuously so as to obtain a final product which does not have the above mentioned drawbacks.

Thus the object of the present invention consists of a device for processing non fluid products in an inert atmosphere and at a controlled temperature particularly food products, comprising a plurality of machines or mechanisms adapted for providing washing, mechanical processing and packing of the processed product, characterized in that it consists to produce and maintain an inert atmosphere enclosing the machines and mechanisms for providing the processing of the product in the zone for preparing the product from its introduction in said zone till its removal out of said zone, and in that means as lock are provided to introduce the product at the inlet of the zone and to remove the product out of the zone after processing.

According to another main characteristic of the invention, a sealed enclosure defines a chamber filled with an inert atmosphere at a low overpressure inside which is located a succession of processing and transfer stations, the enclosure being provided with an inlet lock and an outlet lock.

According to an advantageous arrangement of the invention, the inlet lock is an immersion lock formed of a tank filled with a rinsing liquid, disposed both inside and outside the enclosure, through which it passes through an opening provided in one of the walls, said wall at the edge of this opening plunging into the liquid and forming a barrier between the outside air and the inert atmosphere of the chamber.

According to yet another interesting characteristic of the invention, a packing machine of a type known per se is associated with a hopper connected sealingly to one of the last transfer devices provided in the preparation zone and forms a lock for moving the product from the preparation zone.

Figure 2:
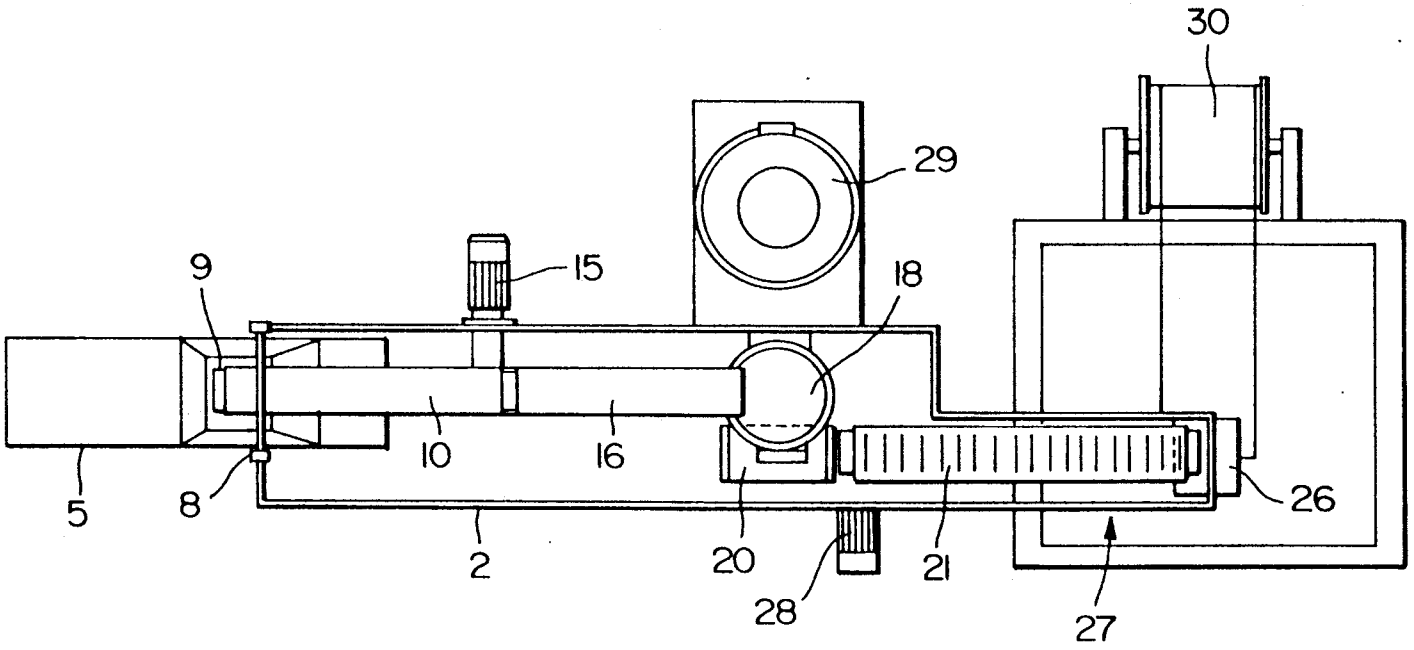

Other particular characteristics as well as the advantages of the invention will be clear from the following description of a particular embodiment in which reference is made to the accompanying drawings, which show:

FIG. 1, a schematic elevational view of a processing machine;

FIG. 2, a top view of the machine of FIG. 1.

In the FIGURES, a machine has been shown for processing and packing fried potatoes which may be considered as a particular and non limitative embodiment, in which modifications may be made without departing from the scope of the invention. A zone 1 for preparing the product comprises essentially a sealed enclosure 2 of parallelepipedic shape which rests on supports 3. An end of the enclosure, at its lower part, has an opening 4 in one of its side walls. This opening allows a tank 5 filled with a rinsing liquid 6 to be positioned on the bottom of the enclosure and thereinside. The level of the liquid is such that the upper edge of the opening 4 on the side wall of the enclosure plunges into the liquid which then forms a barrier between the outside air and the inert atmosphere chamber 7, inside the enclosure. It is obvious that tank 5, at its longitudinal edges, closes the lateral portions of opening 4 sealingly, for example by means of seals 8 (visible in FIG. 2) so that there is no communication between chamber 7 and the outside. This liquid filled tank thus forms an immersion lock at the inlet of the inert atmosphere zone formed by enclosure 2. The bottom of tank 5 has a pit 9 which serves for housing at the lower end 6 continuous belt elevator 10 returning over a lower drum 11 immersed in liquid 6 and an upper drum 12 located inside and at the upper part of enclosure 2 and driven by an external motor 15. Belt 11 carries buckets or palettes 13 which can remove the potatoes which will have been poured into tank 5 outside the enclosure, as shown by the arrow in FIG. 1 and which, washed by liquid 6, will be oriented by the guide plate 13 towards pit 9 and be taken up by said belt elevator 10. With this latter is associated a fixed lower plate 17 for collecting the rinsing liquid and returning it to tank 5.

Still inside the inert atmosphere chamber 7, the potatoes which escape from the elevator at the level of the upper drum are collected by a draining conveyor 14, also formed of an endless continuously travelling belt 16 which is obviously formed of flexible mesh permitting flow of the rinsing liquid, as can be seen more clearly in FIG. 2. This liquid is advantageously recycled towards the rinsing bath 6.

The draining conveyor 14 feeds the drained potatoes into an intake spout 18 of a cutting machine 19. The potatoes cut by this machine to the desired forms or dimensions, still within the inert atmosphere in the closed chamber 7, leave on a new discharge belt 20 which transfers them to another endless elevator belt 21, of a design similar to belt 10. It will be noted that belt 21 moves upwards inside a sealed cover 27 which communicates with enclosure 2. Thus, whole the belt 21 also is inside an inert atmosphere chamber as chamber 7. Belt 21 is driven by a motor 28 disposed outside enclosure 2 (FIG. 2).

The cut potatoes are, during their travel on belt 21, subjected to another rinsing by a spraying device 22 which splashes a mixture of water and metabisulfite, or of any other antioxidant agent, all of them dosed with accuracy. The potatoes thus cut and processed are taken up to the top of the elevator belt 21 and poured into a hopper 23 which is sealingly connected to cover 27 just below the upper end of belt 21. This hopper orients the cut potatoes towards a tube 24 at the bottom of which they are collected in a packing bag 25. The bag is sealed by a bagging machine 26, of known type, which thus plays the role of outlet lock because the plastic film forming the packing bag, after sealing and because of its shape, forms a feed tube identical to tube 24 and a small laminar slit between the tube and the outside is created. From cover 27, in which an inert atmosphere, for example nitrogen, is maintained as in chamber 7 at a pressure slightly greater than the atmospheric pressure, this relative overpressure is established in tube 24 and prevents the ambient air from entering the bag subjected to the same nitrogen pressure, the end of the bag being sealed previously. This discharge station which forms a last lock also has as objective to keep the product isolated during its transfer from the manufacturing enclosure to its packing bag, before it is sealed at its upper part by machine 26.

From the immersion lock (5, 6) provided at the inlet to the enclosure as far as the bagging machine 26 which forms an outlet lock, the product in question is processed continuously inside an enclosure 7 with inert atmosphere. The inert atmosphere in enclosure 2, for example as was mentioned by means of a nitrogen atmosphere at a low overpressure, is provided conventionally by an inert atmosphere source by means of fluids inlet and outlet ducts having appropriate valves, not shown. Similarly, the inert atmosphere in chamber 7 is kept at a strictly controlled predetermined temperature by conventional means not described or shown. A certain number of mechanisms are moreover provided outside the sealed enclosure 2. In the embodiment shown, it is a question of drive motors 15 and 28 mentioned above but also of the mechanism 29 for driving the cutting machine 19 and its discharge belt 20, as well as mechanism 30 associated with control of the bagging machine 26. The motion transmission members and the different pipes connecting mechanism 29 and machine 19 together of course passing sealingly through enclosure 2.

Variants of construction may be provided without departing from the scope of the present invention. Thus, the cutting station may also be placed inside the rinsing bath 6 but in the inert atmosphere chamber 7, which thus avoids having two belt transfer mechanisms in said chamber. Similarly, these belt elevators could be replaced by other transfer members, without departing from the scope of the present invention.

The invention has been described with respect to a preferred embodiment for processing potatoes with a view to deep-freezing and freezing and/or packing same. It goes without saying that the invention is not limited to this particular application, but also finds a use for other products in the food field and particularly for processing food emulsions. In this case, the product could be fed into the inert atmosphere processing zone by means of an inlet lock which would for example be placed upstream of a crusher. An inlet lock for empty packs as well as an outlet lock for filled packs, namely pots or containers containing the product, would then be provided at the inlet and outlet of the preparation zone which would contain, besides the crusher, the appropriate packing machine. More generally, the invention would also find a use in other fields than the food industry, such as the chemical, pharmaceutical, cosmetic industries and for all applications which require continuous processing of the product in an inert atmosphere, with inlet lock and outlet lock.

We claim:

1. An apparatus for processing non-fluid products, and particularly food products, in a inert atmosphere, said apparatus including product washing means, product mechanical processing means and processed product packing means, all disposed within a sealed enclosure including an atmosphere inlet lock and an atmosphere outlet lock for entrance and exit, respectively, of products into and from the interior of said sealed enclosure, the interior of said sealed enclosure containing a temperature controlled atmosphere of inert gas at a pressure slightly greater than ambient atmospheric pressure, said inlet lock including a liquid atmosphere lock, said product washing means comprises said inlet lock so that said products enter said enclosure while being washed, washed product first conveying means operative to convey washed products from said washing means to said product mechanical processing means, second conveying means operative to convey mechanical processed products from said product mechanical processing means to said processed product packing means, said processed product packaging means comprises said atmosphere outlet lock so that said products are packaged as they exit said enclosure.

2. The apparatus of claim 1 wherein said first conveying means includes an elevator conveyor incorporating a lower end operatively associated with said product washing means for receiving products washed therein and elevating washed products from said product washing means to said product mechanical processing means.

3. The assembly of claim 2 wherein said product mechanical processing means is operatively associated with the upper end of said elevator conveyor for receiving washed elevated products therefrom.

4. The apparatus of claim 3 wherein said product mechanical processing means includes means for cutting the product received from said elevator conveyor upper end.

5. The apparatus of claim 4 wherein said product second conveying means includes conveyor means operative to receive products from said mechanical processing means and to convey processed products to said product packing means.

6. The apparatus of claim 4 wherein said product mechanical processing means includes a drainage conveyor disposed upstream from said means for cutting said product and operative to receive washed products from the upper end of said elevator conveyor, drain liquid from said washed products during conveyance thereof along said drainage conveyor, and discharge said drained products from said drainage conveyor to said means for cutting said product.

* * * * *